US006267485B1

(12) United States Patent
Rodgers

(10) Patent No.: US 6,267,485 B1
(45) **Date of Patent: *Jul. 31, 2001**

(54) ILLUMINATED BAG

(76) Inventor: Nicholas A. Rodgers, c/o Shaw & Co. SJ0892, P.O. Box 025216, Miami, FL (US) 33102

( * ) Notice: Subject to any disclaimer, the term of this patent is extended or adjusted under 35 U.S.C. 154(b) by 0 days.

This patent is subject to a terminal disclaimer.

(21) Appl. No.: 09/604,956

(22) Filed: Jun. 28, 2000

Related U.S. Application Data

(63) Continuation of application No. 08/562,401, filed on Nov. 24, 1995, now Pat. No. 6,158,872, which is a continuation of application No. 08/490,746, filed on Jun. 15, 1995, now abandoned, which is a continuation-in-part of application No. 08/266,501, filed on Jun. 27, 1994, now abandoned, which is a continuation-in-part of application No. 08/149,908, filed on Nov. 10, 1993, now Pat. No. 5,339,294, and a continuation of application No. 08/439,375, filed on May 11, 1995, now Pat. No. 5,622,422, which is a continuation-in-part of application No. 08/234,110, filed on Apr. 28, 1994, now Pat. No. 5,461,815, which is a continuation of application No. 08/072,390, filed on Jun. 7, 1993, now Pat. No. 5,330,282.

(51) Int. Cl.[7] ..... A45C 15/06
(52) U.S. Cl. ..... 362/156; 362/276; 362/802
(58) Field of Search ..... 362/103, 108, 362/156, 276, 802; 315/861, 360, 200 A, 209 CD, 209 R; 307/115

(56) References Cited

U.S. PATENT DOCUMENTS

| | | | | |
|---|---|---|---|---|
| 4,535,392 | * | 8/1985 | Montgomery | 362/103 X |
| 5,434,759 | * | 7/1995 | Endo et al. | 362/108 |
| 5,523,927 | * | 6/1996 | Gokey | 362/103 |
| 6,158,872 | * | 12/2000 | Rodgers | 362/156 |

* cited by examiner

*Primary Examiner*—Stephen Husar
(74) *Attorney, Agent, or Firm*—Robert L. Westell

(57) ABSTRACT

A bag which may be carried by hand or over the shoulder has a light controlled by a timing circuit so that the light is only turned on for a set period by an OFF to ON transition of a motion responsive switch occurring outside the set period. A manually operated normally open switch may allow control of the light state independently of the timing circuit.

5 Claims, 5 Drawing Sheets

ILLUMINATED BAG

This application is a continuation of application Ser. No. 08/562,401 filed Nov. 24, 1995 now U.S. Pat. No. 6,158,872, which is a continuation of application Ser. No. 08/490,746 filed Jun. 15, 1995 now abandoned, which is a Continuation-in-Part of application Ser. No. 08/266,501 filed Jun. 27, 1994, now abandoned, which is a Continuation-in-Part of application Ser. No. 08/149,908 filed Nov. 10, 1993, now U.S. Pat. No. 5,339,294; and a Continuation-in-Part of application Ser. No. 439,375 filed May 11, 1995 now U.S. Pat. No. 5,622,422 which is a Continuation-in-Part of application Ser. No. 08/234,110 filed Apr. 28, 1994 now U.S. Pat. No. 5,461,815, which is a Continuation of application Ser. No. 08/072,390 filed Jun. 7, 1993 now U.S. Pat. No. 5,330,282.

This application relates to a carrying bag.

By "carrying bag" herein, I include those known as haversacks, and knapsacks, and shoulder bags.

There is provided such a bag, having a light arranged, so that when on, it is visible outside the bag. A timing circuit is adapted when activated to time a power interval. A motion responsive switch responds to motion of the bag to provide alternating on-to-off and off-to-on transitions. The timing circuit is responsive to an off-to-on transition occurring outside a power interval to initiate a power interval. (The timing circuit is connected to ignore an off-to-on transition occurring during a power interval). The light forms part of an illumination circuit. The illumination circuit is designed, in combination with the timing circuit so that the illumination circuit receives power during the power interval. The illumination circuit is further designed so that the light will be illuminated at least once during the power interval. As an example of the range of alternatives, the illumination circuit may cause the light to stay on for the duration of the power interval; or, during the power interval, to cause the light to flash or be on for a shorter duration one or more times during the power interval. (Other variants are readily available to those skilled in the art).

The light may be of any type, but a light emitting diode LED, is thought to provide the best combination of light intensity and low power requirements.

The invention so far described has the quality of providing a motion responsive light which signals the presence of the bag (and a carrier) or provides a novelty effect. The automatic termination by the timing circuit of the power interval effects great battery savings. A further savings is achieved by the fact that a power interval cannot be initiated during an existing one. Thus, a power interval cannot be extended under conditions of continuous motion. It is thought, therefore, that the battery life will normally exceed the life of the carry bag.

Preferably there is provided a manually operable normally open switch. The switch is located in a strap of the carry bag, preferably, conveniently located to allow manual activation by the carrier of the bag.

By "manually" herein, I include "digitally" and being subject to pressure by any part of the carrier's body.

The manually operable switch is located to directly connect the battery with the illumination circuit independently of the timing circuit and the timing circuit switch. This manual switch and its connection allows the bag carrier to turn on the light at any time independently of the duration dictated by the power interval. The fact that use of the manually operated switch may shorten the battery life; with normal operation of the switch, the battery life is still expected to exceed the normal bag life. Thus the battery, as well as the circuitry, may be permanently installed in the bag. Although the light may be other than a light emitting diode ("LED"), LED's are usually preferred since the intensity is much higher relative to the power required, than with other light sources.

In drawings which illustrate a preferred embodiment of the invention:

Figure 10:
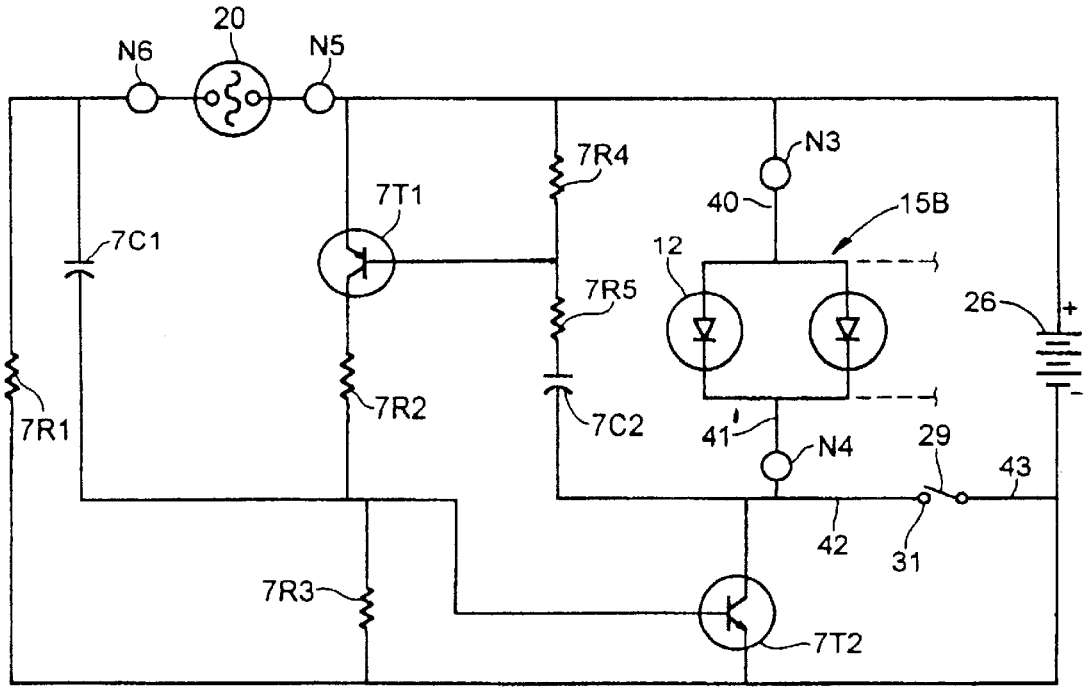
Figure 4:
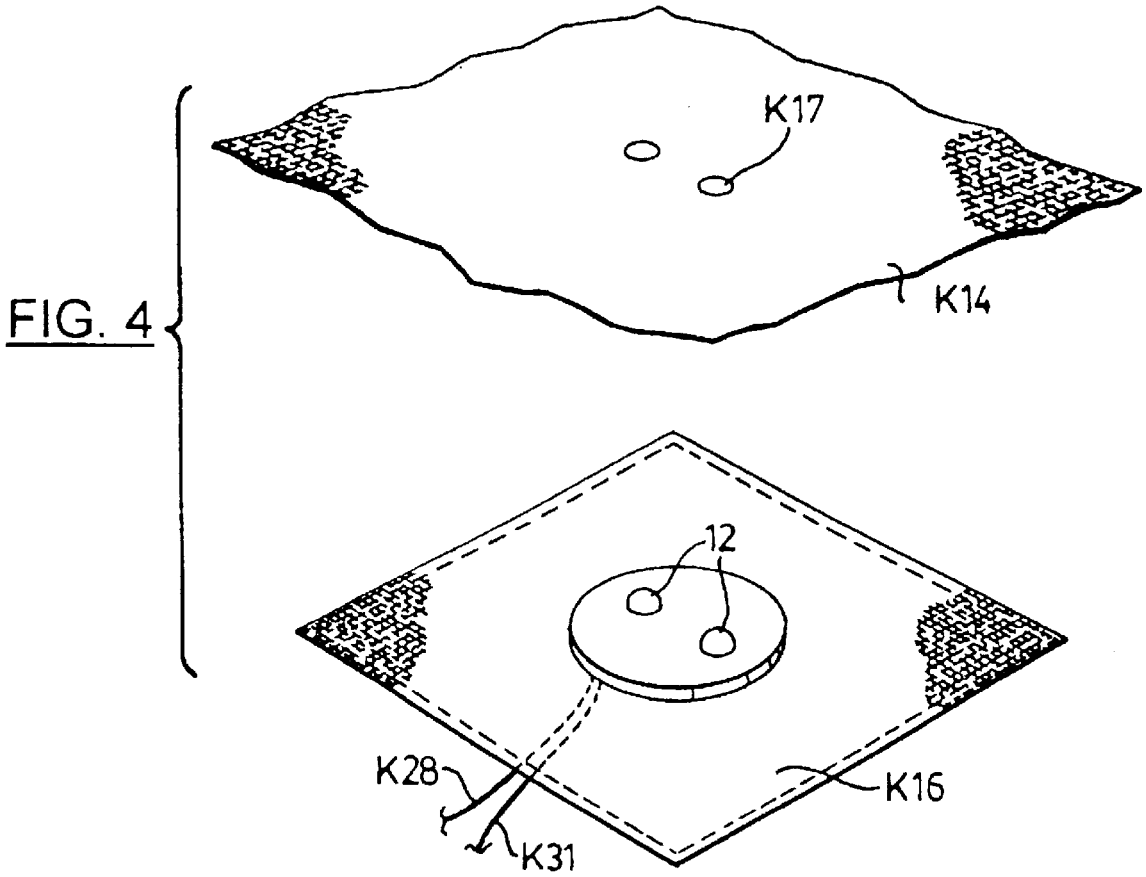
Figure 5:
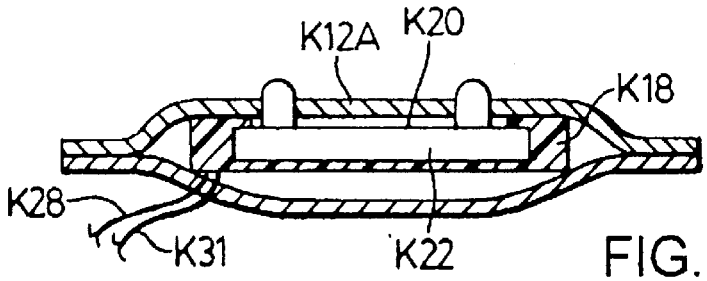
Figure 6:
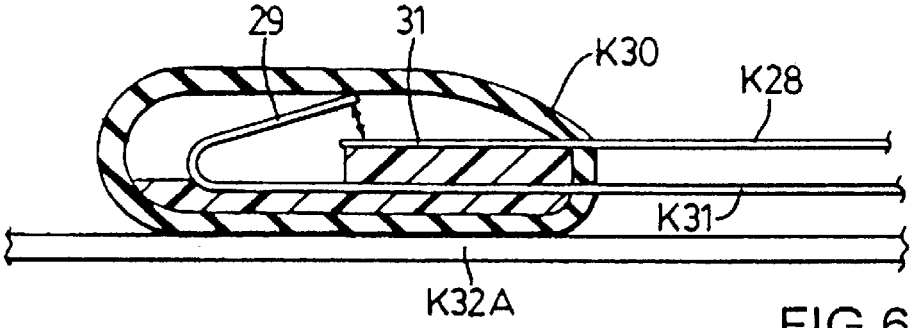
Figures 7, 8, 9:
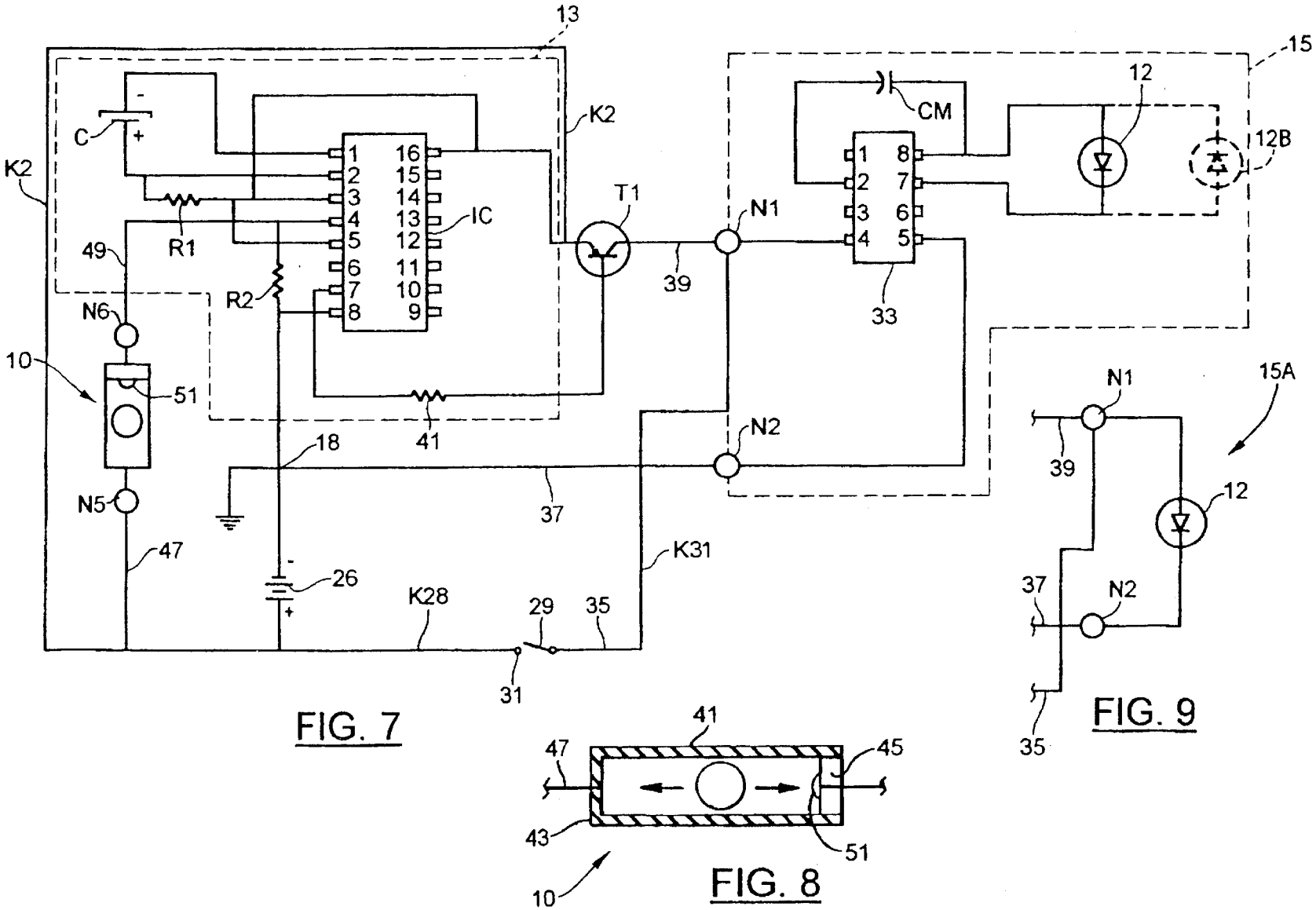
Figure 11:
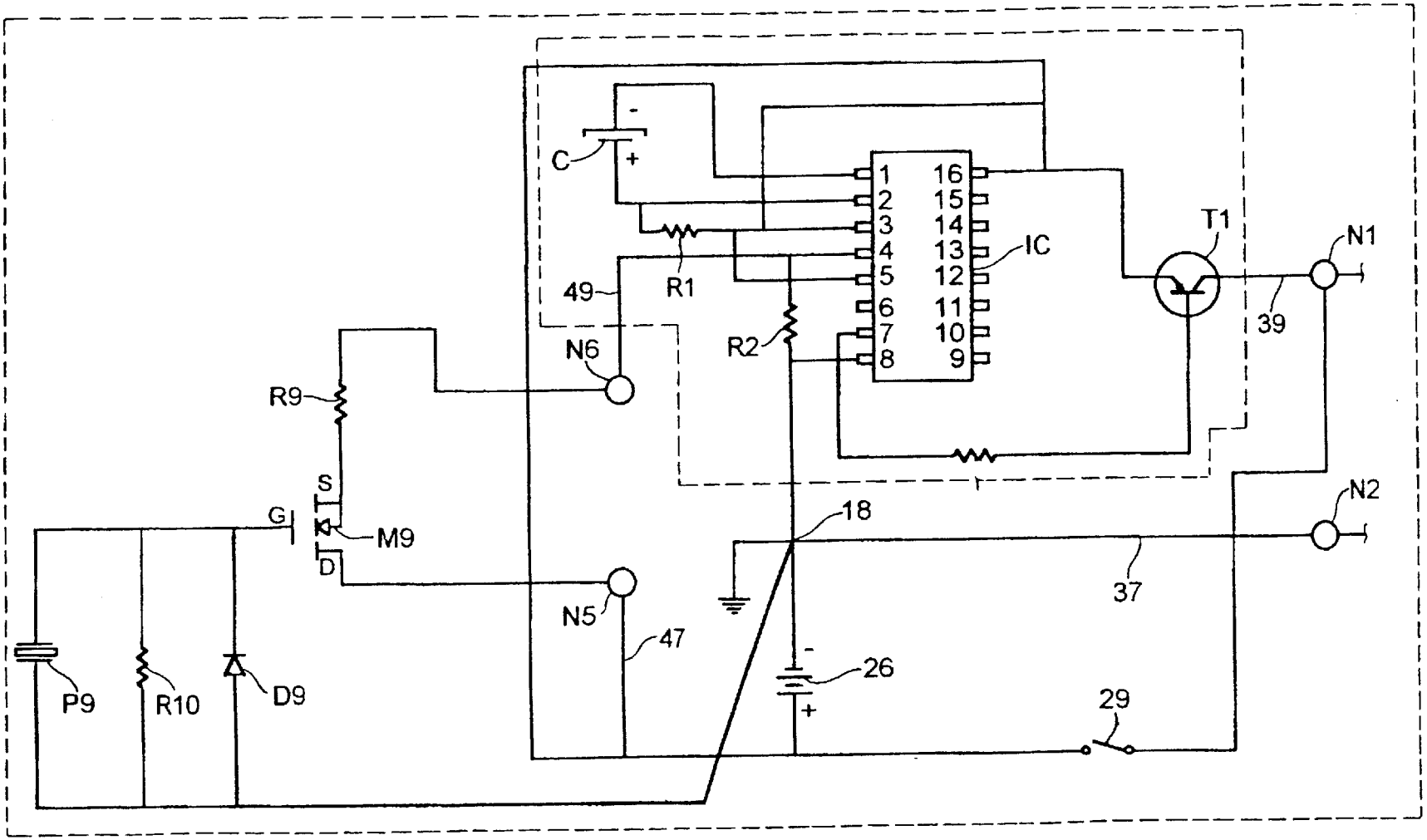

FIG. 4 is an exploded view of the mounting for a pair of LEDs and the associated components, FIG. 5 is a section through a bag wall shows the mounting of the LED and its associated components, FIG. 6 is a section showing an example of a normally open manually operable switch mounted on a strap of the bag, FIG. 7 shows the preferred embodiments for the timing circuit and the illumination circuit, FIG. 8 shows a preferred form of motion responsive switch, FIG. 9 shows an illumination circuit which is an alternate to that shown in FIG. 7, FIG. 10 shows a timing circuit which is an alternate to that shown in FIG. 7, FIG. 11 show a timing circuit employing a piezotronic motion responsive switch.

Figure 1:
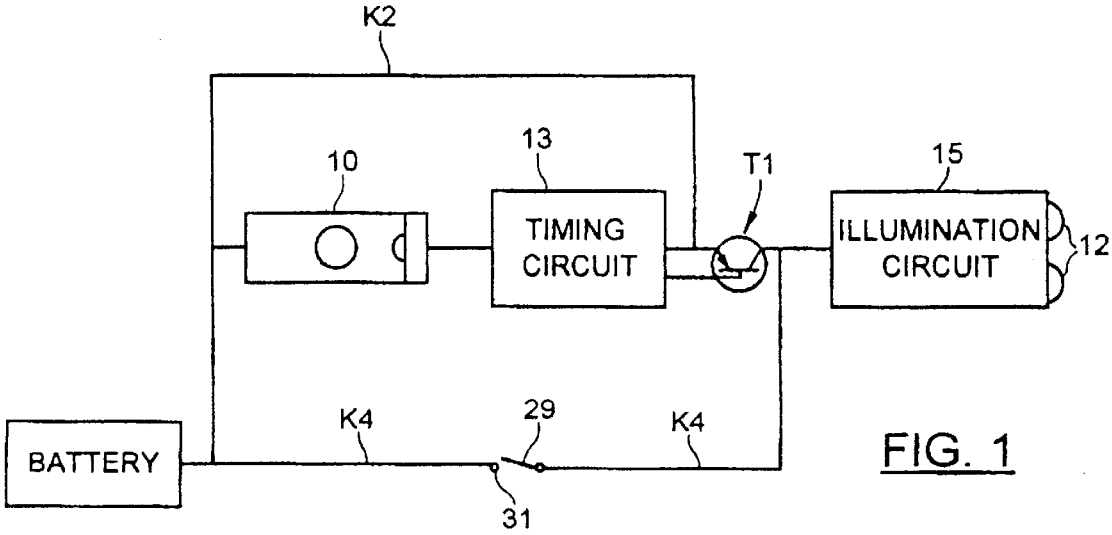
FIG. 1 is a schematic of the circuitry of the invention.

In the drawings, FIG. 1 shows schematically the preferred overall circuitry wherein a battery is connected to an illumination circuit over line K2 to the emitter of timing circuit switch T1. T1's collector is connected to the illumination circuit 15 which includes LED's 12. The battery is also connected over motion responsive switch 10 to timing circuit 13 which controls the base of T1. The battery is also connected to the illumination circuit over manually operable open switch 29-31.

In operation, in the absence of motion and with switch 29-31 open, the base of T1 will be sufficiently positive so that T1 is "off" or "open" and no power is supplied to illumination circuit 15. When the circuitry (and the device to which it is attached) is in motion, motion responsive switch 10 will experience alternating off-to-on and on-to-off transitions. On the occurrence of the first off-to-on transition when the timing circuit is not timing, a power interval will lower the base of T1 so that the battery supplies power over K2 and T1 during the power interval, and, during this interval, the LED's 12 will be on or will flash in accord with the design of the illumination circuit. Off-to-on transitions of switch 10 occurring during a power interval will not extend the power interval nor will they otherwise affect the circuit. Power savings are achieved by this arrangement, as well as the automatic turn off after the power interval. Closure of the manually operable switch 29-31 will connect the battery to the illumination circuit for operation of the latter in accord with its design. Release of the manually operable switch will open the circuit and halt the flow of power over 29-31 to the illumination circuit. Thus, the flow of power over line K4 and the flow of power on line K2 are independent of one another. The circuitry shown in FIG. 1 will be described in detail hereafter.

Figure 2:
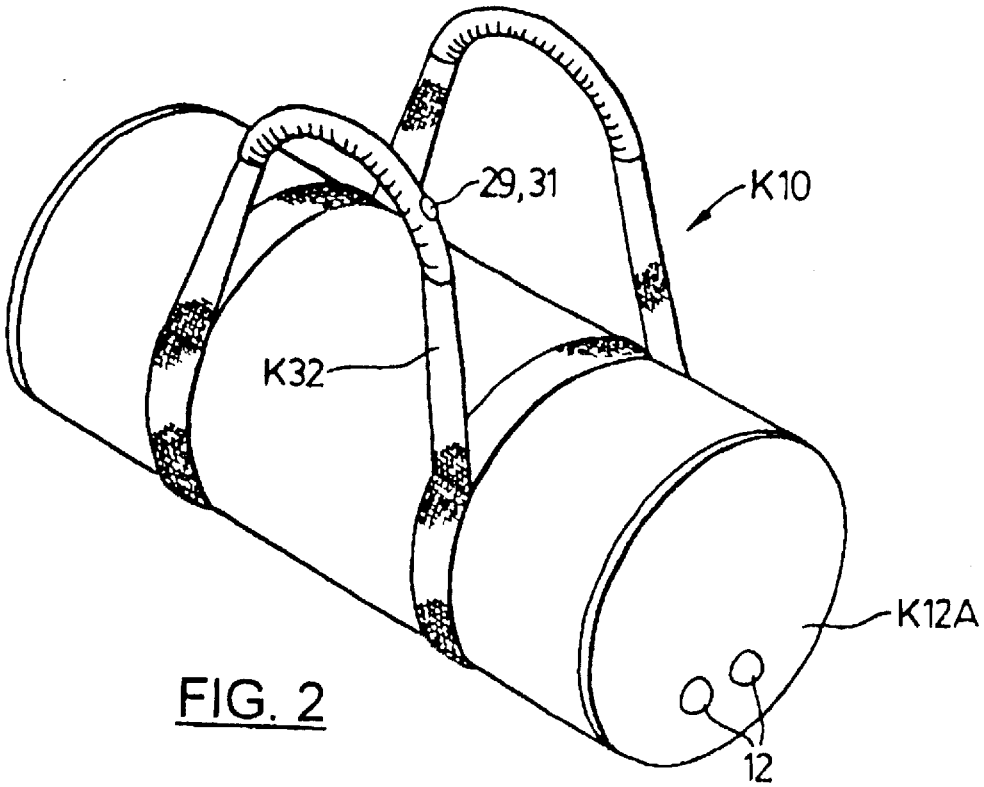
FIG. 2 is a sports type bag in accord with the invention.
Figure 3:
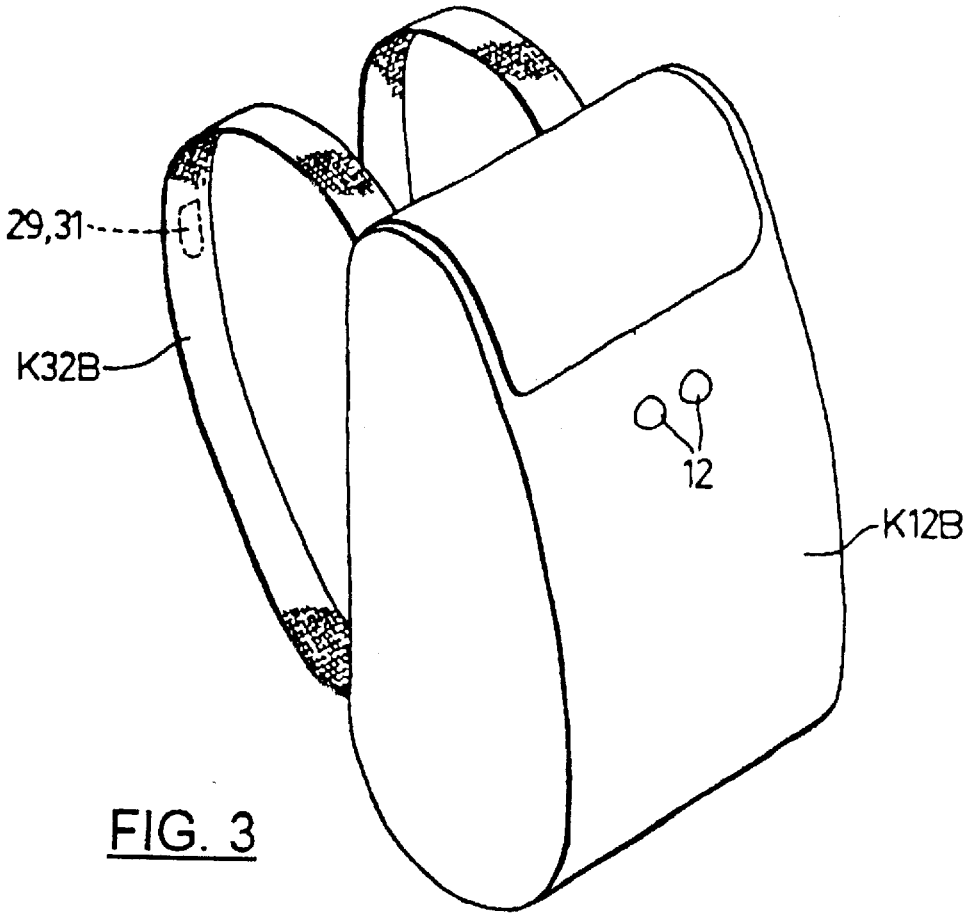
FIG. 3 is a haversack in accord with the invention.

FIG. 2 shows a carry bag K10 with two handles having LED's 12 exposed on surface K12A on one end of the bag The bag has a manually operable switch 29-31 mounted on one of the bag straps K32. Similarly, FIG. 3 shows a carry bag in the form of a haversack having LED's 12 visible on a surface of the haversack which is exposed in use. A carry bag with one strap only (not shown) may embody the invention, may have the LEDs visible on an exposed surface of the bag and the manually operable switch in the single bag strap.

The invention may also be employed on a carry bag without straps.

FIGS. 4 and 5 show the preferred physical form of the LED's and their operating circuitry (except for the manually operable switch.)

In FIGS. 4 and 5 is shown the exposed layer K12A of carry bag K10 having apertures K17 suitable for projection therethrough of LED's 12. A patch of fabric K16 is preferably attached to the rear side of layer K14 and sewn or otherwise attached at the borders to form a pocket for receipt of the LED and circuitry.

The LED and circuitry may be arranged in any desired arrangement which is convenient. As an example, a plastic molding K20 may hold LED's 12 and circuitry schematically represented by K22. The block K22 represents any convenient physical arrangement (which may vary widely from article to article) suitable to the article. The electronic arrangement of the circuit elements is shown in FIG. 7. It will be noted that the electronic circuitry is preferably encapsulated in the plastic of K18 except for the leads K28, K31 leading to the manually operable switch. In most cases it is found that the light and electronic unit K18 and K22 may be maintained in position by the restraints provided by the material surrounding the apertures K17 acting on the LEDs 12 and the restraint provided by patch K16 and fabric K12A on the capsule K22. However, if desired, the capsule may be glued or otherwise affixed to the rear of the fabric K14, and, in this latter event, the patch K16 might possibly be dispensed with.

FIG. 6 shows an example of a manually operable switch 29-31 comprising a resilient conducting member 29 biased. into spaced relationship to conducting member 31 and moveable under manual pressure to bring members 29-31 into contact to close the switch. Members 29 and 31 are respectively connected to the electronic circuit through leads K31 and K28. The switch preferably is sealed in a flexible plastic enclosure K30, the flexible plastic being flexible enough to allow the manual depression of arm 29 to close the switch and, when the manual pressure is released, to allow arm 29 to again move to open position. The plastic enclosure may be attached to a carry strap K32A by adhesive or any other known means.

FIG. 3 shows a knapsack or haversack having an exposed layer K12B and carry strap K32B. The LED and electronics capsule may be attached to layer K12B by a patch K16 as illustrated in FIGS. 4 and 5. The manually operable switch 29-31 may be mounted on a strap K32B of the knapsack as shown in FIG. 3.

It will be realized that should the carry bag have no straps, then the switch 29-31 will be mounted to be actuable from outside the surface of the carry bag where it is easily manually accessible.

FIG. 7 illustrates the preferred electronic arrangement of the timing circuit 13 and the illumination circuit 15.

The LED's 12 may include a lens of any type to focus or disperse the rays.

FIG. 7 shows a preferred circuit for use with the band of FIGS. 1–3. In FIG. 7 is shown timing circuitry 13 for timing an interval during which power is supplied to the illumination circuit 15.

Preferred values for the timing circuit elements are as follows:

IC—INTEGRATED CIRCUIT #RR8503 MC14528

T—TRANSISTOR #2N3906

C—CAPACITOR 0.47 $\mu$F at 30V

10—ACTIVATION SWITCH, MECHANICAL

12—LIGHT SOURCE (LED)

26—TWO BATTERIES, EACH OF 1½V

R1—RESISTOR 1 MEGOHM ⅛ W

R2—RESISTOR 1 MEGOHM ⅛ W

R3—RESISTOR 1 MEGOHM ⅛ W (A mercury or a piezotronic switch may be used as an alternative to mechanical switch 10).

(The integrated circuit and transistor referred to above are both available from Motorola Canada Limited, 3125 Steeles Avenue East, North York, Ontario, Canada).

In operation, with the switch 10 open and the circuit quiescent, capacitor C will be charged to the value of battery 26 (here 3 V). Pin 4 of the integrated circuit will be held at 0 volts which is the voltage arbitrarily designated at node 18. The integrated circuit IC will be in reset condition having the effect that there will be a positive voltage at pin 7, rendering the transistor T1 non-conducting and preventing the supply of power to the illumination circuit and maintaining the LED's off.

When motion of the bag causes switch 10 to close, (performing an off-to-on transition), it closes the connection from the positive side of battery 26 to pin 4; the '0' to '1' or 0 volt to 3 volt change at pin 4 causes the integrated circuit to go to "set" condition causing pin 7 of the integrated IC to go to 0 volts. This causes T1 to conduct, allowing the supply of power to illumination circuit 15 to cause lighting of LED's 12 in accord with the illumination circuit design as hereinafter described. The initiation of "set" condition of integrated circuit IC connects pin 3 with node 18, and, in a time determined by C and R1 the circuit is returned to "reset" condition, turning off T1, thus terminating the flow of power to illumination circuit 15 and terminating the illumination or flashing of LED 12 and allowing C to recharge. The integrated circuitry IC is further designed so that switch 10 must be turned off (an on-to-off transition) and on again (an off-to-on transition) before integrated circuit may again be activated to set state.

The preferred motion responsive switch 10 is best shown in FIG. 8 and comprises a conducting cylinder 41 having a conducting end 43 and an insulating end 45. The line 47 from battery 26 is connected to conducting end 43. The line 49 leading to pin 4 is connected through insulating end 45 to a terminal 51. When the ball moves, under motion of the switch and band to connect terminal 51 and cylinder 41, it closes the switch and performs an off-to-on transition. In other positions the switch is open.

The switch shown may be replaced by any other motion responsive switch such as a switch where, under motion, a pendular contact from time to time contacts a stationary contact. The switch 10 may be replaced by a mercury switch although mercury is by some considered a danger as a potential pollutant. The switch may also be piezotronic where the signal to pin 4 is caused by impacting or flexing the piezo element.

It is now desired to describe the illumination circuit 15. As shown in FIG. 7, this comprises a National Semiconductor Chip Number 3909 connected as shown on FIG. 7 as oscillator 33. The basic multivibrator circuit of oscillator 33 is modified by the use of a higher capacity capacitor CM to produce a longer "on" time which, for example may be two seconds. The connections 39 and 37 from timing circuit 13 are connected to the battery terminals 4 and 5 respectively of the chip. When, due to an off-to-on transition at pin 4 of the integrated circuit IC, conduction is initiated through T1, a quartz crystal in chip 33 vibrates to cause periodic poser to be applied intermittently (as selected) to the chip output terminals 8 and 7. The rate of vibration can be varied by changing the value of capacitor CM connected between terminals 2 and 8 of chip 33. When terminal 8 is positive relative to 7 LED 12 will flash on and will be off at other times. When the terminals 8 and 7 polarity is reversed, LED 12B will flash. Either LED may be considered as representing a number of LEDs in parallel.

When T1 is turned off, the power from timing circuit 13 and hence the power interval is terminated and the flashing ceases.

Chip 33 may be replaced by other chips (which are available) with more outputs which will allow more LEDs to be used and selectively controlled. Other sequencing means may be used as desired to control the flashing of LED's 12 and/or 12B over the power interval when T1 is conducting.

T1 may of course may be replaced by any other switching means under control of the timing circuit.

In FIG. 9 is shown the simplest type of illumination circuit 15A which may be considered as replacing that as shown in FIG. 7. This FIG. 9 shows node N1 connected to line 39 to the T1 collector and over contact 29 of the manually controlled switch, while node N2 is connected over line 37 to node 18. During the power interval, when T1 is conducting, positive power illuminates LED 12, and termination of T1 conduction turns LED 12 off. LED 12, in the circuit shown is steadily on for the power interval.

It will be appreciated that the "ground" shown at node 18 is instrument, ground only and is unconnected to anything outside the circuit. The choice of node 18 as "ground" is somewhat arbitrary but assists on the description of the circuit.

The use of the circuitry shown in FIG. 6 transcends the need for an "OFF" attitude of the switch 10 to conserve battery power as it ensures only one short illumination of the LED per switch 10 closure. This allows the bag to be held or left where, due to the attitude of the bag, switch 10 is closed, without continuing illumination of the LED and consequent battery 26 power depletion. Battery 26 is referred to in the singular although it may be the series connection of two batteries.

When it is desired to voluntarily control the commencement and duration of the illumination, normally open push switch 29-31, is closed to connect the battery directly to the illumination circuit 15 turning on or flashing the LEDs. When switch 29-31 is open the LED's are extinguished unless activated by the motion responsive switch.

Although continuing depression of the switch 29-31 will deplete battery power, under normal usage of switch 29-31 the battery life will still be maintained for a considerable period to the extent that it is expected that it will outlive the owner's possession of or interest in the bag.

In FIG. 10 is shown an alternate circuit to that of FIG. 7. In FIG. 10 the integrated circuit IC is replaced by discrete elements. A schematic distribution of these elements in the capsule is not shown but it will be realized that they are placed as found convenient while the LED's are placed as shown in FIGS. 1–3 and normally open switch 29-31 is located as is switch 29-31 in FIGS. 1–3.

Exemplary only values of the circuit elements of FIG. 7 are indicated below:

7 R1—1 MEGOHM
7 R2—1 KILOHM
7 R3—100 KILOHM
7 R4—47 KILOHM
7 R5—1 KILOHM
7 C1—0.1 $\mu$F
7 C2—10 $\mu$F
7 T1—2N3906 PNP
7 T2—2N3904 NPN
12—LIGHT SOUCES (LEDS)
20—ACTIVATION SWITCH, MERCURY *
29-31—OVERRIDE SWITCH, NORMALLY OPEN PUSH BUTTON
(A mechanical or a piezotronic may be used)

FIG. 7 shows a simple one shot circuit with an override circuit added. Ignoring, initially the override circuit, that is assuming 29-31 is open, then the remaining circuitry is as follows.

In FIG. 7 the timing circuit is connected to the illumination circuit at nodes N3 and N4.

When mercury switch 20 is closed providing an off-to-on transition, it applies positive voltage to 7C1 and the base of 7T2. This will cause 7T2 to conduct. This, in turn, causes the LEDS 12 to turn on.

7T2 conducting also connects the negative side of 7C2 to the negative side of the battery. This will place the base of 7T1 at a potential less positive than its emitter which will cause it to conduct. 7T1 supplies positive voltage to the voltage divider 7R2 and 7R3 which supplies positive voltage to the base of 7T2. This will hold 7T2 on after 7C1 has charged and no longer conducts current to the base of 7T2.

The RC network formed by the resistors 7R4, 7R5, and 7C2 determine the length of time the LEDS will be on. When 7C2 charges, the potential on the base of 7T1 becomes less negative and 7T1 will cease to conduct. This, in turn removes the positive bias from the base of 7T2 which will turn off and current will cease to flow to the LEDS.

To repeat the cycle, switch 20 must be opened and then reclosed to provide a new off-to-on transition of the switch, 20.

Thus if, for any reason the switch 20 remains closed the LED's will be extinguished by the circuit described above after the illumination duration provided by the RC network.

When it is desired to voluntarily control the commencement and duration of the illumination, normally open switch 29-31, is closed to connect the battery directly across the LED or LED's 12, illuminating them. When switch 29-31 is opened the LED's are extinguished.

The LEDs are connected between node N3 on line 40 and node N4 on line 41', and thus comprise the illumination circuit 15B (identical electrically to FIG. 6 illumination circuit 15A).

It is within the scope of the invention to combine the timing circuitry of FIG. 10 with an oscillator circuit, in which case the illumination circuit 15 of FIG. 7 would be connected across nodes N3 and N4 in place of illumination circuit 15B. However, the power interval provided by the timing circuit of FIG. 10 is scarcely long enough to produce a useful sequence of flashes.

The switch 10 of FIG. 10 is interchangeable with the mercury switch 20 or any other motion responsive switch.

The normally open switch 29-31 is interchangeable a push button switch or any other normally open manually depressable switch.

It cannot be said that the circuit of FIG. 7 is always preferable over that of FIG. 10 or vice versa. The circuitry of FIG. 10 is somewhat simpler. However, the circuitry of FIG. 7 may be made extremely compact. The integrated circuit of FIG. 7 may take advantage of a process called "on board integrated circuitry". In this process the integrated circuit, IC, is actually built into a (very small) circuit board and covered with a dot of epoxy. The size of the integrated circuit of FIG. 7 is about 3/16 inch in diameter and only 1/32 of an inch thick.

The circuits of FIG. 7 or FIG. 10 would require 3V power but it is preferred to use two 1½V batteries in series. These batteries are collectively shown and referred to as battery 26.

In FIG. 11 is shown a timing circuit similar to timing circuit 13 of FIG. 7 except that motion responsive switch 10 between nodes N5 and N6 has been removed and a piezotronic circuit connected (as the motion responsive switch) instead. Thus a piezotronic member M9 comprises a source S, drain D and gate G. The source is connected through resistor R9 to N6 and the drain to N5. The piezotronic element P9, a resistance R10, and diode D9 are connected in parallel between the gate and a line to node 18. The diode is poled to conduct toward the gate.

In use, an impact on or a flexure of the piezotronic member P9, by means, not shown but easily available to those skilled in the art, applies a signal to the gate. The negative cycle of any such signal is grounded through diode D9. A positive signal causes conduction from drain to source and, as in the otherwise identical circuitry of FIG. 7 (see page 7 starting at line 23) closes the connection from battery 26 to pin 4 causing the integrated circuit to go to 'set' condition, initiating the power interval of the timing circuit and consequent activation of the illumination circuit. As with the other alternative circuits further signals during the power interval from P9 and conduction through M9, have no effect on the timing of the power interval or the downstream operator of the circuits. As before a new power interval may only be initiated by conduction through M9 initiated after the previous power interval has terminated.

The piezotronic circuit may also be used with the circuitry of FIG. 10 by removing mercury switch 20 from between N5 and N6, and there connecting the drain and source, respectively, of the piezotronic circuit while a line is connected in parallel to the negative of battery 26 with the diode poled as in FIG. 11.

In operation then a carrying bag in accord with the invention will preferably have a timing circuit in accord with 15 of FIG. 7, that of FIG. 10, or that of FIG. 11; and an illumination circuit, in accord with 15 of FIG. 7 or that of FIG. 9. In the absence of motion and without closure of manual switch 29-13 the LED's will be off.

On motion of the bag the first off-to-on transition of the motion responsive switch the timing circuit will start the timing of a power interval. During the timing of the power interval battery power will be supplied to the illumination circuit. If the illumination circuit 15 is used then the LED's will flash, during the power interval, in accord with the design of the oscillator. (Other flash sequences could be provided). If the illumination circuit is in accord with FIG. 9 the LED's will be on during the power interval. At the end of the power interval, the supply of power to the illumination circuit will be terminated. This is a first important power saving feature.

During the existence of a power interval, off-to-on transitions of the motion responsive switch will be ignored by the timing circuit. Thus a new power interval may only occur due to an off-to-on transition occurring in the absence of a power interval. This is a second important power saving feature. The first and second power saving features are believed to act in most cases to extend battery life to outlive the useful life of the bag. Hence the circuitry, with the exception of the manually operable switch, may be encapsulated.

If a manually operable switch is part of the circuitry, the illumination circuit will be operated during closure of the manually operable switch independently of the operation of the illumination circuit due to the timing circuit illumination due to the operation of the manually operable switch will cease with the cessation of manual pressure on the switch.

Even with the added power demands due to normal use of the manually operable switch it is believed that the life of the battery will approximate the useful life of the bag, so that the battery and circuitry, other than the manually responsive switch may be encapsulated.

What is claimed is:

1. A bag, a light to provide illumination exterior thereto, an illumination circuit, a battery a motion responsive switch, a timing circuit for timing a power interval, a power switch, said battery being connectible to said illumination circuit by closure of said power switch, said illumination circuit being adapted to cause light to flash at least once during connection to said battery, said timing circuit being adapted to close said power switch during said power interval, said timing circuit being responsive to an OFF to ON transition of the motion responsive switch, at a time outside a power interval to initiate a power interval, a manually closable switch biased to open position.

2. A bag, means for providing illumination exterior to said bag comprising:

a battery, a light visible exterior to said bag able to assume ON and OFF states, an acceleration responsive switch able to assume OPEN and CLOSED states, means responsive to said switch achieving CLOSED state when said light is in OFF state to turn said light to ON state, a manually operable switch able to assume open and closed states, biased to open position, means responsive to said manually operable switch achieving closed state when said light is in OFF state to turn said light to ON state.

3. Bag lighting apparatus including a battery, a light, a first circuit including an acceleration responsive switch, a second circuit including a normally open manually operable switch between said battery and said light, in parallel with said first circuit, said first circuit for connecting said battery to said light responsive to closure of said acceleration responsive switch, said second circuit connecting said battery to said light responsive to closure of said manually operable switch.

4. Bag lighting apparatus as claimed in claim 3 wherein said first circuit includes timing means adapted to disconnect said battery from said light a predetermined time after the connecting of said battery to said light.

5. Bag lighting apparatus as claimed in claim 4 where said timing means times an interval between the connecting of said battery to said light and said timing means ignores means connecting when an interval is being timed.

* * * * *